US011107311B2

(12) United States Patent
Mejenborg et al.

(10) Patent No.: US 11,107,311 B2
(45) Date of Patent: Aug. 31, 2021

(54) LOTTERY TICKET BIN WITH PULL-OUT DRAWER AND TICKET GUIDE CONFIGURATION

(71) Applicant: Scientific Games International, Inc., Newark, DE (US)

(72) Inventors: Sten Hallundbaek Mejenborg, Cumming, GA (US); Timothy Masocol, Woodstock, GA (US); James Jonathan Holbrook, Cumming, GA (US); Mark Andrew Thompson, Buford, GA (US)

(73) Assignee: Scientific Games International, Inc., Newark, DE (US)

( * ) Notice: Subject to any disclaimer, the term of this patent is extended or adjusted under 35 U.S.C. 154(b) by 140 days.

(21) Appl. No.: 16/596,919

(22) Filed: Oct. 9, 2019

(65) Prior Publication Data

US 2021/0110630 A1 Apr. 15, 2021

(51) Int. Cl.

| | |
|---|---|
| ***G07F 11/18*** | (2006.01) |
| ***G07F 11/00*** | (2006.01) |
| ***G07F 11/68*** | (2006.01) |
| ***G07F 17/42*** | (2006.01) |

(52) U.S. Cl.

CPC ..... *G07F 11/18* (2013.01); *G07F 11/007* (2013.01); *G07F 11/68* (2013.01); *G07F 17/42* (2013.01)

(58) Field of Classification Search

CPC .... G07F 17/329; G07F 11/68; G07F 17/3216; G07F 17/42; G07F 11/007; B65D 83/0805; B65D 83/0894; G07B 3/04; G07B 7/00

See application file for complete search history.

(56) References Cited

U.S. PATENT DOCUMENTS

| | | | |
|---|---|---|---|
| 7,467,738 | B2 | 12/2008 | Woods et al. |
| 2010/0308071 | A1 | 12/2010 | Businger |
| 2017/0018148 | A1 | 1/2017 | Behm et al. |

OTHER PUBLICATIONS

EPO Search Report, dated Feb. 24, 2021.

*Primary Examiner* — Gene O Crawford
*Assistant Examiner* — Ayodeji T Ojofeitimi
(74) *Attorney, Agent, or Firm* — Dority & Manning, P.A.

(57) ABSTRACT

A lottery ticket dispenser array includes a plurality of interconnected bins, wherein the bins include a housing having a bottom and an open top. A drawer is slidable into and out of the housing and includes an open top and a ticket compartment configured for receipt of a stack of the interconnected lottery tickets in a laid-down orientation. A component section adjacent in the drawer is configured to automatically dispense the lottery tickets through a dispense slot upon receipt of a dispense command. A ramp is disposed within the ticket compartment and is angled upwards from a floor of the ticket compartment towards the component section. The ramp includes a plurality of raised ridges extending across the ramp and spaced longitudinally apart along the ramp, wherein each ridge defines a retaining edge for progressively longer stacks of interconnected lottery tickets placed within the ticket compartment in the laid-down orientation.

19 Claims, 5 Drawing Sheets

LOTTERY TICKET BIN WITH PULL-OUT DRAWER AND TICKET GUIDE CONFIGURATION

BACKGROUND

Instant lottery tickets (e.g., "scratch-off" lottery tickets) are sold at many types of retail locations including, stores, such as grocery stores, general merchandise stores, and the like. Various configurations of lottery ticket dispensers have been proposed in the industry for this purpose, including electronic dispensers that automatically dispense a ticket from a bin or compartment upon receipt of an electronic command signal.

For example, U.S. Pat. Publication No. 2017/0018148 describes a lottery ticket dispenser array that is configured in communication with a lottery ticket terminal and includes a plurality of separate dispensing bins having a different respective lottery ticket stored therein. For example, the dispenser array may include ten separate bins, with each bin containing a supply of different scratch-off lottery ticket games. Each lottery ticket contained in the bins includes a machine readable code printed thereon, such as a bar code, QR code, or the like. Each bin in the array includes an electronic drive mechanism that, when activated, dispenses one or more lottery tickets from the bin (depending on the number of tickets requested by the patron). Each bin also includes a scanner disposed to read the code on lottery tickets dispensed from the bin position. In operation of the system, the lottery ticket terminal transmits a purchase signal for dispensing a particular lottery ticket that is routed to the respective bin containing the lottery ticket, which activates the drive mechanism to dispense the requisite number of tickets. As the tickets are dispensed from the bin, the scanner may read the code printed on each ticket, which eventually results in a signal being routed to a central lottery server for each lottery ticket dispensed from the dispenser array. The code printed on each ticket contains identifying information unique to the ticket, and the signal transmitted to the central server enables actions relevant to the sale of the tickets, such as activating the ticket in the lottery provider's system, accounting for tickets sold at a particular retail establishment, reconciling tickets sold at a retail establishment with tickets delivered to the establishment, and for forth.

In the '148 publication, the stack of individual interconnected lottery tickets are maintained in an upright orientation within the bins. However, this array configuration has a disadvantage for an "under-counter" environment wherein the array would be placed beneath a counter at the point of sale (POS) location. The array has a tall height profile due to the height of the individual bins and access into the bins to load the lottery tickets is only by opening the front cover of the bins, which would be extremely inconvenient for the lower bins if the array were placed on or close to the floor and under a counter.

Configuring the individual bins with a shortened height profile that corresponds to the thickness of the flat ticket pack is beneficial in that the overall height of the array can be significantly reduced for under-counter applications. However, this requires a "laid-down" flat orientation of the ticket stack, which presents problems with maintaining proper alignment of the tickets as they are pulled from the top of the fan-folded ticket pack. At least every other ticket must fold at least partially over itself in the dispense cycle, and this folding can result in ticket jams if not done in a controlled manner. The issue becomes more pronounced when tickets that have been dispensed out of the slot (but not separated) must be retracted back into the bin. It is important that such tickets fold back onto the stack in the same manner in which they were drawn from the stack. This process can be particularly problematic.

It would also be desirable if the individual bins could accommodate tickets of varying length in the laid-down orientation to increase the versatility of the bins and dispenser overall. However, different ticket lengths dispensed from the same bin present a unique set of dispensing issues and potential ticket jams.

Thus, a ticket bin having a low profile wherein the lottery tickets of varying length are laid flat and positively guided during the dispense and retract sequences to minimize ticket jams would be beneficial in the art.

SUMMARY

Objects and advantages of the invention will be set forth in part in the following description, or may be obvious from the description, or may be learned through practice of the invention.

In accordance with aspects of the invention, a lottery ticket dispenser array having a plurality of individual ticket bins is provided. The array is particularly well-suited as an "under-counter" array due to its low profile and ease of loading new ticket stacks into the individual bins in a laid-down configuration (e.g., laid flat and not on-edge). One or more of the bins (preferably all of the bins) in the array includes a housing having a bottom and an open top. A drawer is slidable into and out of the housing and includes an open top and at least one ticket compartment configured therein for receipt of a stack of the interconnected lottery tickets through the open top of the drawer. A component section is configured adjacent a front of the drawer to automatically dispenses one or more of the lottery tickets through a dispense slot upon receipt of a dispense command. The component section is configured with control components such as, for example, a motorized drive mechanism, a scanner or other optical reader, a tear bar or perforation separation edge, a control board, and so forth.

A ramp is disposed within the ticket compartment and is angled upwards from a floor of the ticket compartment towards the component section. This ramp may be an integrally formed component of the drawer (e.g., co-molded with the drawer) or may be defined by an insert that is placed into the drawer.

A plurality of ridges are defined transversely across the ramp and are spaced longitudinally apart along the ramp. Each ridge may be continuous or discontinuous (e.g., a plurality of spaced apart mini-ridges or teeth) across the ramp, and need not extend completely across the ramp. Each ridge defines a retaining edge or wall for progressively longer stacks of interconnected lottery tickets placed within the ticket compartment in the laid-down orientation, each retaining edge defining a space for a certain length of ticket stack. The retaining edge or wall may be angled towards a back wall of the drawer.

In a particular embodiment, the ramp comprises a concave curved profile. This configuration aids in inducing a curved profile to longer stacks of the interconnected lottery tickets, which has been shown to be beneficial in preventing jams and limiting the height profile of the drawer for longer stacks.

In a particularly useful embodiment that can receive and dispense four progressively longer stacks of interconnected lottery tickets, a back edge of the ramp defines a first one of the ridges such that a first space is defined between the first ridge and a back wall of the drawer for receipt of a first stack of interconnected lottery tickets. A second one of the ridges is spaced from the first ridge further up on the ramp such that a second space is defined between the second ridge and the back wall of the drawer for receipt of a second stack of interconnected lottery tickets that is longer than the first stack of interconnected lottery tickets. Likewise, a third one of the ridges is spaced from the second ridge further up on the ramp such that a third space is defined between the third ridge and the back wall of the drawer for receipt of a third stack of interconnected lottery tickets that is longer than the second stack of interconnected lottery tickets.

It should be appreciated that any number of the ridges may be provided on the ramp depending on the number of different lengths of ticket stacks intended to be dispensed from the drawer.

In certain embodiments, a vertically orientated concave face is defined at a front edge of the ramp adjacent the component section and is oriented towards the back wall of the drawer. This concave face defines an uppermost retaining wall (similar to one of the ridges) such that a fourth or final space is defined between the concave face and the back wall of the drawer for receipt of a forth or longest stack of interconnected lottery tickets that can be received in the ticket compartment.

The concave face may include a rounded top edge that overhangs the concave face towards the back wall of the drawer, the rounded top edge spaced below a bottom of an adjacent vertically stacked bin to define a ticket path to the component section having a defined height. This height is designed so as not to restrict free passage of the tickets to the component section while at the same time reducing the risk of folded ticket jams forming in the passage.

In some embodiments, for each bin, the drawer is configured to store and dispense at least two separate stacks of interconnected lottery tickets and includes adjacent component sections and adjacent ticket compartments, with each ticket compartment comprising the ramp with plurality of ridges as in the embodiments discussed above.

The present invention also encompasses individual ones of the bins discussed above for use in a multi-bin dispenser array in a vertically stacked configuration with other bins.

BRIEF DESCRIPTION OF THE DRAWINGS

A full and enabling disclosure including the best mode of practicing the appended claims and directed to one of ordinary skill in the art is set forth more particularly in the remainder of the specification. The specification makes reference to the appended figures, in which:

DETAILED DESCRIPTION

Reference will now be made in detail to various and alternative exemplary embodiments and to the accompanying drawings, with like numerals representing substantially identical structural elements. Each example is provided by way of explanation, and not as a limitation. In fact, it will be apparent to those skilled in the art that modifications and variations can be made without departing from the scope or spirit of the disclosure and claims. For instance, features illustrated or described as part of one embodiment may be used on another embodiment to yield a still further embodiment. Thus, it is intended that the present disclosure includes modifications and variations as come within the scope of the appended claims and their equivalents.

Figure 1:
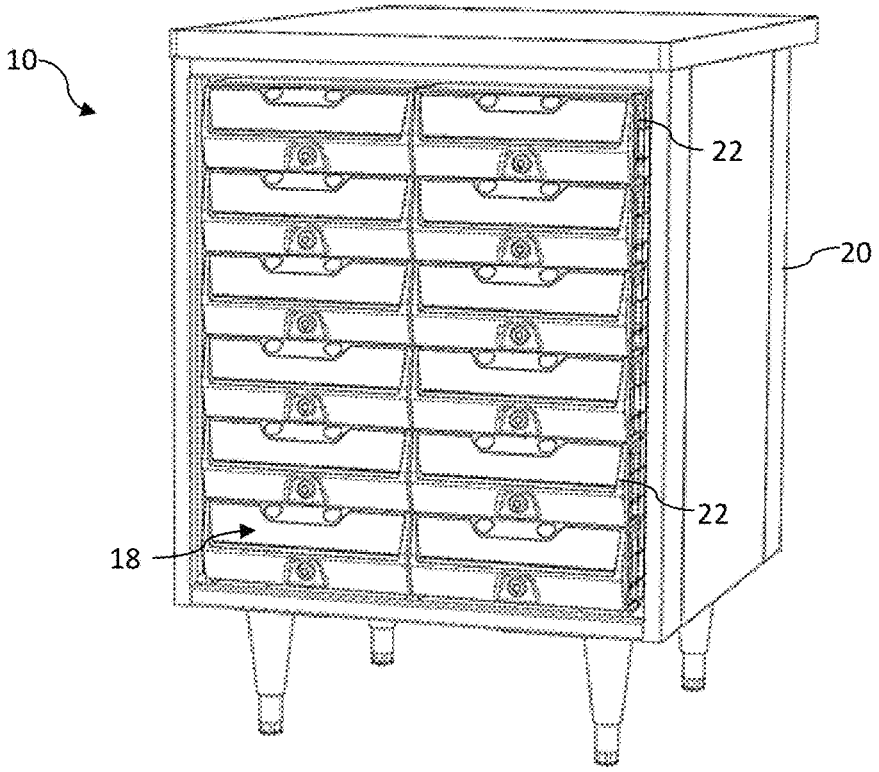
FIG. 1 is a perspective view of an embodiment of a lottery ticket dispenser array within a cabinet in accordance with aspects of the present invention.

FIG. 1 depicts an embodiment of a dispenser array 10 for dispensing interconnected lottery tickets 62 (FIGS. 5*a*-5*d*) at a retail establishment, such as a convenience store, retail store, pub, restaurant, or the like, that is generally authorized by a lottery jurisdiction to carry out lottery activities, such as the sale of instant scratch-off tickets or terminal printed draw tickets for games such as Powerball™. The lottery jurisdiction may be a state lottery authority, such as the Pennsylvania Lottery, or any other governmental jurisdictional authority. A separate game provider may be partnered with the lottery jurisdiction to provide certain control, implementation, and logistical functions of the game. It should be appreciated that the type of retail establishment or lottery jurisdiction entities are not limiting factors of the invention.

Figure 2:
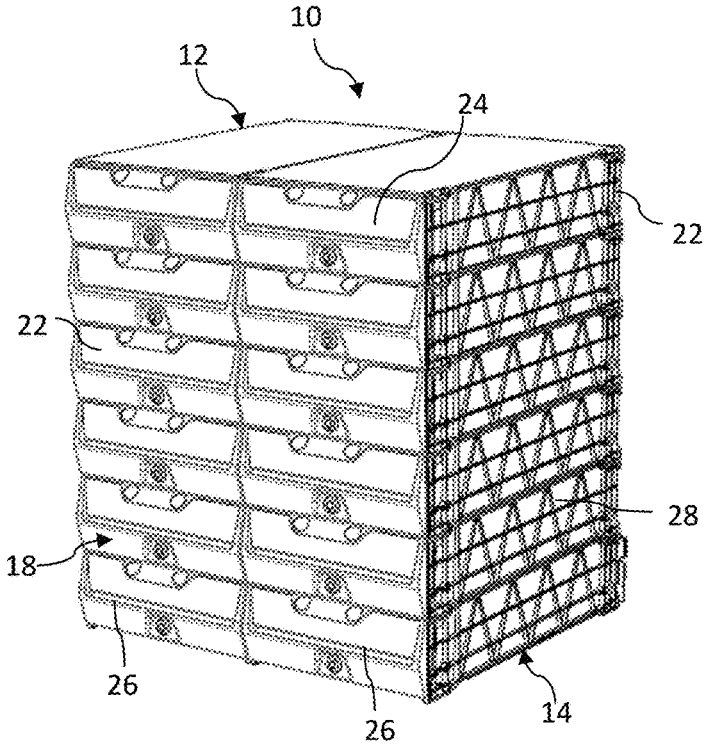
FIG. 2 is a front perspective view of the lottery ticket dispenser array removed from the cabinet.
Figure 3:
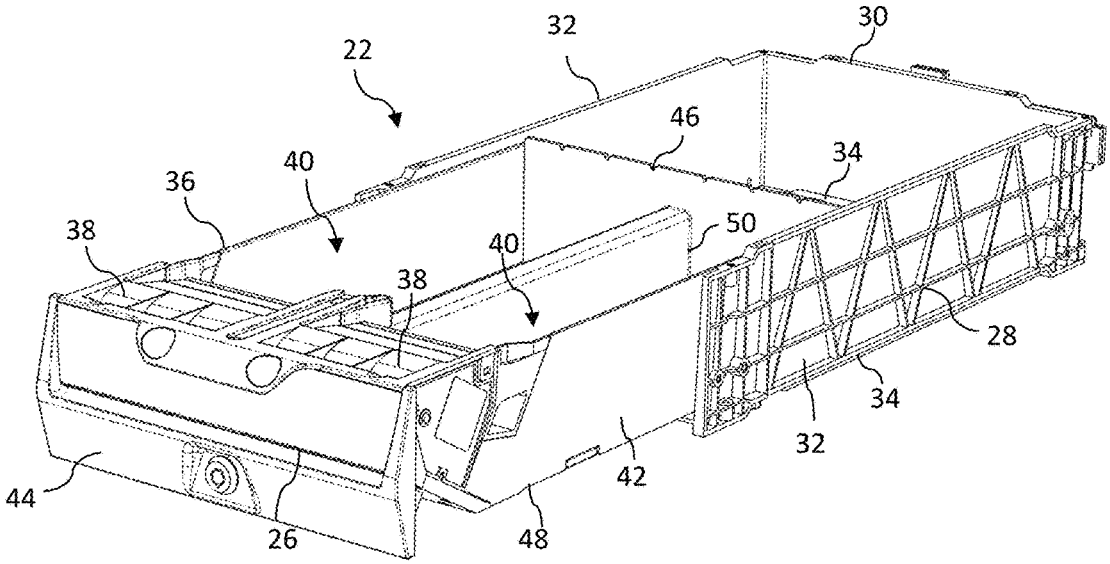
FIG. 3 is a front perspective view of an individual ticket bin from the lottery ticket dispenser array of FIG. 2.

Referring to FIGS. 1-3 in general, the array 10 includes a plurality of separate ticket bins 22 (described in greater detail below) that, collectively, define a top 12, sides 14, back 16, and front 18 of the array 10. The bins 22 may be physically interconnected within the array 10 by any manner of suitable structure provided on the sides, top, or bottom of the bins 22. Each bin 22 has a front face 24 with a dispensing slot 26 through which lottery tickets 62 contained in the bin 22 are dispensed.

In the depicted embodiment, the bins 22 (and hence the array 10) have a relatively low height profile and are designed to contain a flat stack 60 (FIGS. 5*a*-5*d*) of fan-folded and interconnected lottery tickets 62 laid flat in the respective bins 22 (e.g. a laid-down orientation). The individual lottery tickets 62 are separated by perforation lines within the stack 60. This configuration is particularly well-suited for an "under-counter" system wherein the array 10 is operationally located within a cabinet 20 (FIG. 1) that is sized to fit under a retail counter. This arrangement removes the array from on or above the retail counter and frees up valuable space at the point of sale (POS) counter at the retail establishment, which is highly desirable to retailers.

Figure 4:
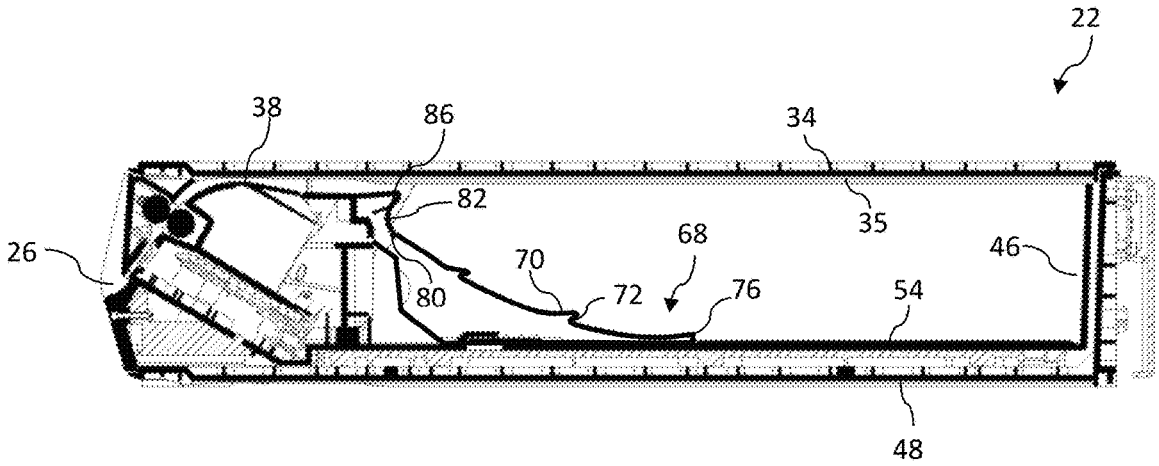
FIG. 4 is a cut-away side view of a the individual ticket bin.

Referring to FIGS. 3 and 4, each bin 22 defines at least one internal ticket compartment 40 for receipt of a supply of lottery tickets, for example in the form of a fan-folded stack 60 of interconnected tickets in a laid-down orientation. In the depicted embodiment, each bin 22 is configured to house and dispense two separate supplies of lottery tickets and includes side-by-side ticket compartments 40 separated by an internal wall 50, wherein each ticket compartment 40 is configured as described herein.

Each ticket compartment 40 includes an operational component section 38 at the front thereof that may include a drive mechanism, scanner or other type of reader, cutting bar, edge, or other separation mechanism, control circuitry, and so forth. It should be appreciated that each bin 22 may include any number of ticket compartments 40 and associated component sections 38.

Each bin 22 has an open-top housing structure 28 that includes sides 32, a bottom 34, and a back side 30. The back sides 30 collectively define the back 16 of the dispenser array 10. A circuit board may be fixed to an exterior of the back side 30 of each bin housing 28 and is configured to supply power and control functions to the bin, in particular to the component section 38. For example, as mentioned, each bin 22 (or component section 38 within the bin 22) may include a drive mechanism that dispenses an individual lottery ticket 62 from the bin 22 through the dispense slot 26 upon receipt of a dispense signal via the circuit board or other control component. Each bin 22 (or component section 38) may also include a scanner that reads a code on the lottery ticket as the ticket is dispensed, wherein the scanned code is transmitted from the scanner via the circuit board to a downstream controller or central lottery server/computer that is in communication with the dispenser array 10. It should be appreciated that the array 10 is not limited by the power or control functions that are provided by the circuit boards or other control components, or performed by the operational components within the component section 38.

Each bin 22 includes an open-top drawer 36 that is slidable into and out of the housing 28. The drawer includes sides 42, front wall 44, floor or bottom 48, and a back wall 46. The bottom 48 of the drawer has an outward face or surface 35.

In the illustrated embodiment, the drawer 36 includes the one or more ticket compartments 40, wherein the tickets can be loaded into the compartments 40 through the open top of the drawer 36 in a laid-down or flat orientation. Also, the component sections 38 are configured within and adjacent to the front wall 44 of the drawer 36, and the dispense slot 26 is defined in the front wall 44 of the drawer 36.

Figure 5A:
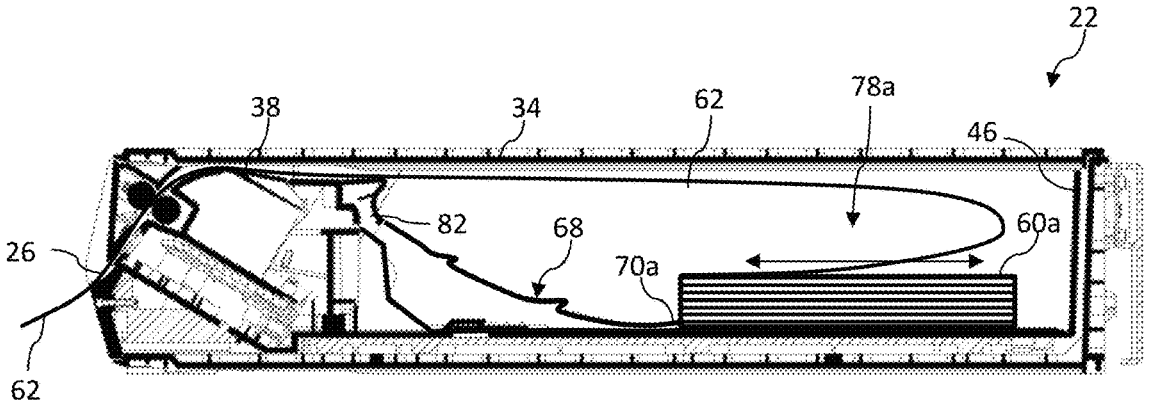
FIGS. 5*a* through 5*d* are cut-away side views of the ticket bin according to FIG. 4 with progressively longer ticket packs received in the ticket compartment of each bin.
Figure 5B:
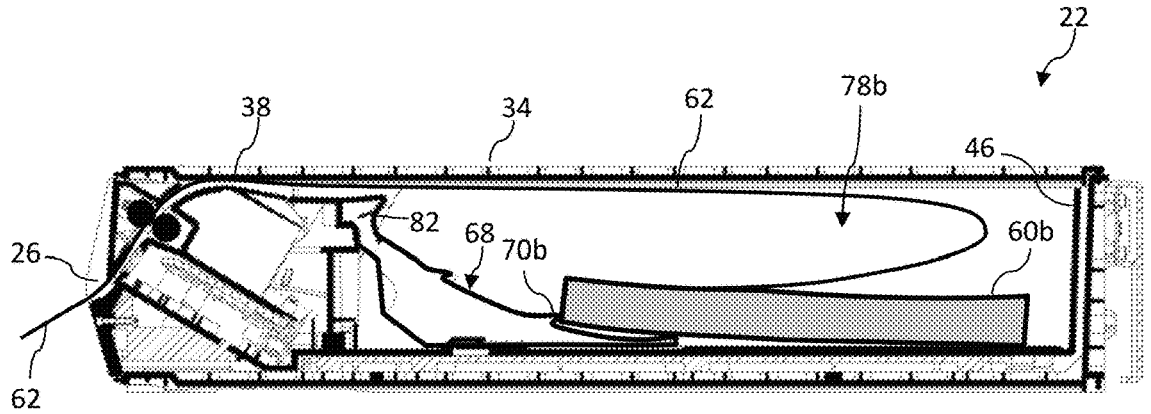
Figure 5C:
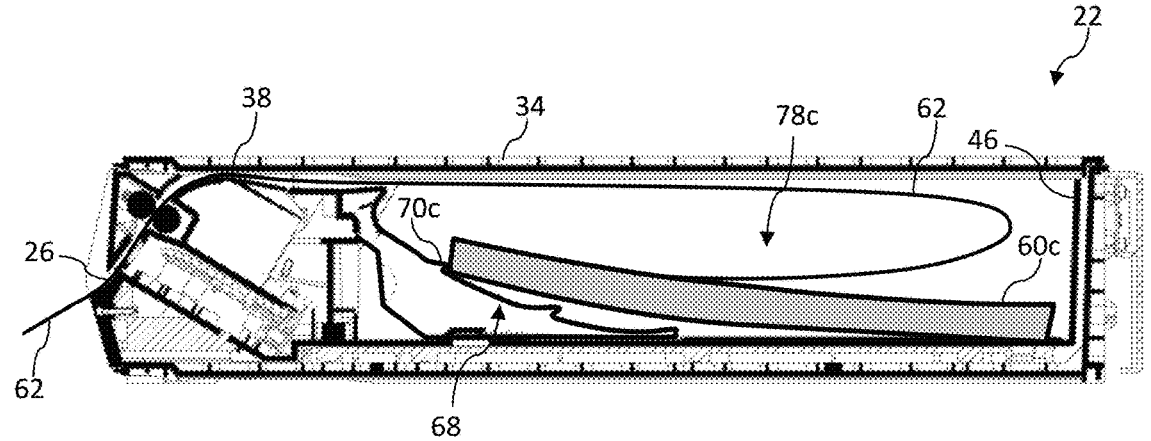
Figure 5D:
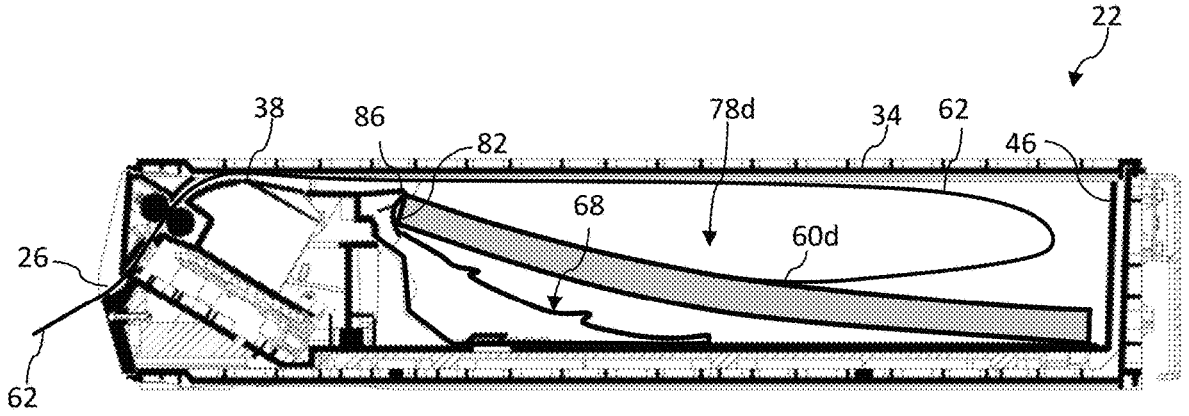
Figure 6:
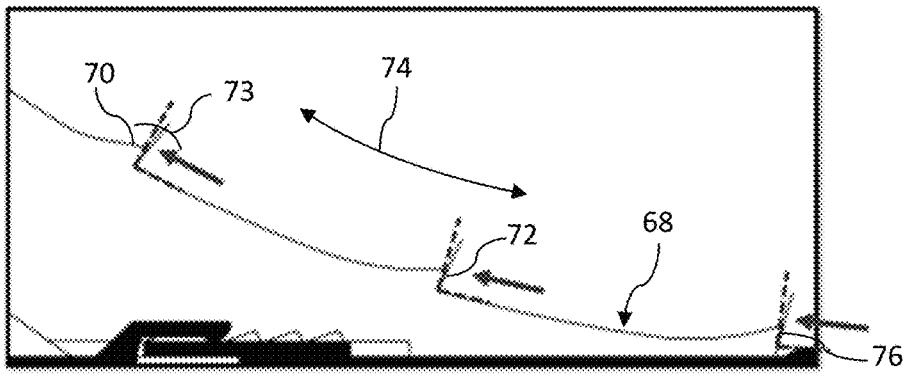
FIG. 6 is a side view of the ramp within the ticket compartment of the ticket bin according to FIG. 4.

Referring to FIGS. 4-6 in general, a ramp 68 is disposed within the ticket compartment 40 and is angled upwards from a floor 54 of the ticket compartment 40 towards the component section 38. This ramp 68 may be an integrally formed component of the drawer 36 (e.g., co-molded with the drawer 36) or may be a separate component, such as an insert that is placed into the drawer 36.

A plurality of longitudinally spaced-apart raised ridges 70 are defined transversely across the ramp 68, wherein the ridges 70 have a progressively higher position in the ticket compartment 40 in a direction towards the component section 38. Each ridge 70 may be continuous (e.g., an unbroken structure) or discontinuous (e.g., a plurality of spaced apart mini-ridges or teeth) across the ramp 68, and need not extend completely across the ramp 68. The ridges 70 need only have sufficient structure and length to support the ticket packs 60 from below.

Each ridge 70 has a height relative to the ramp 68 surface so as to define a retaining edge or wall 72 (FIGS. 4 and 60) that engages a leading edge of a ticket pack 60 and prevents the ticket pack 60 from migrating up the ramp 68. Thus, the ramps 68 with respective retaining edges 72 accommodate progressively longer stacks (60*a*, 60*b*, 60*c*, and 60*d*) of interconnected lottery tickets 62 placed within the ticket compartment 40 in the laid-down orientation, as depicted in FIGS. 5*a*-5*d*. Referring particularly to FIG. 6, the retaining edge or wall 72 may be angled towards the back wall 46 of the drawer 36 relative to ninety-degree angle from the base of the ramp 68, as indicated by the angle 73 in FIG. 6.

In certain embodiments, the ramp 68 has an overall concave curved profile 74, as indicated by FIG. 6. This configuration aids in inducing a curved profile to longer stacks 60 of the interconnected lottery tickets 62 (as seen in FIGS. 5*b*-5*d*), which has been shown to be beneficial in preventing jams as well as limiting the height profile of the drawer 36 for longer stacks 60 on interconnected tickets 62.

Each retaining edge 72 defines a space 78 for a certain length of ticket stack 60. For example, in a particularly useful embodiment depicted in FIGS. 5*a*-5*d*, the bin 22 is configured to accommodate and dispense four progressively longer stacks 60*a*-60*d* of interconnected lottery tickets 62 in the laid-down orientation. In FIG. 5*a*, a back edge 76 (FIG. 4) of the ramp 68 defines a first one of the ridges 70*a* such that a first space 78*a* is defined between the first ridge 70*a* and the back wall 46 of the drawer 36 for receipt of a first stack 60*a* of interconnected lottery tickets 62.

In FIG. 5*b*, a second one of the ridges 70*b* is spaced from the first ridge 70*a* further up on the ramp 68 such that a second space 78*b* is defined between the second ridge 70*b* and the back wall 46 of the drawer 36 for receipt of a second stack 60*b* of interconnected lottery tickets 62 that is longer than the first stack 60*a* of interconnected lottery tickets 62.

Likewise, referring to FIG. 5*c*, a third one of the ridges 70*c* is spaced from the second ridge 70*b* further up on the ramp 68 such that a third space 78*c* is defined between the third ridge 70*c* and the back wall 46 of the drawer 36 for receipt of a third stack 60*c* of interconnected lottery tickets 62 that is longer than the second stack 60*b* of interconnected lottery tickets.

It should be appreciated that any number of the ridges 70 may be provided on the ramp 68 depending on the number of different lengths of ticket stacks 60 intended to be dispensed from the drawer 36.

In the particular illustrated embodiment (FIGS. 4 and 5*d*), a vertically orientated concave face 82 is defined at a front edge 80 of the ramp 68 adjacent the component section 38 and is oriented towards (e.g., faces) the back wall 46 of the drawer 36. This concave face 82 defines an uppermost retaining wall (FIGS. 7*a*-7*c*) similar to ridges such that a fourth or final space 78*d* is defined between the concave face 82 and the back wall 46 of the drawer 36 for receipt of a forth or longest stack 60*d* of interconnected lottery tickets 62 that can be received in the ticket compartment 40. The concave face 82 may be defined by an extension of the ramp 68 or by structure of the component section 38 that is separate from the ramp 68.

Figure 7A:
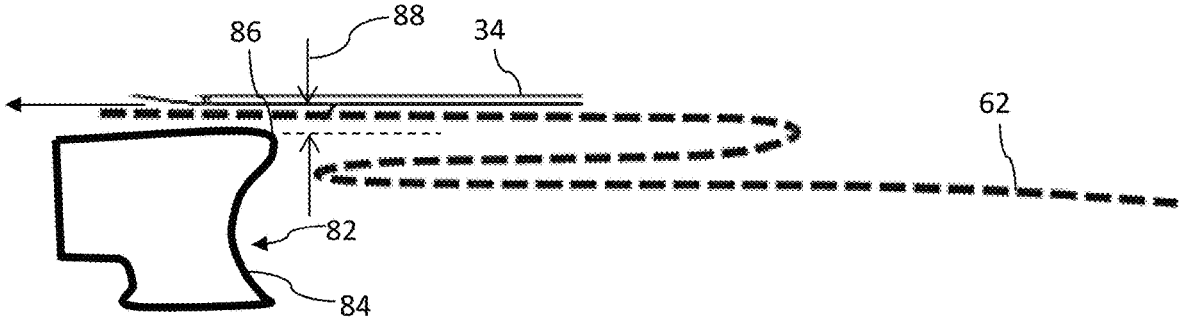
FIGS. 7*a* through 7*c* are progressive side views of interconnected lottery tickets being dispensed at the concave face at the front end of the ramp.
Figure 7B:
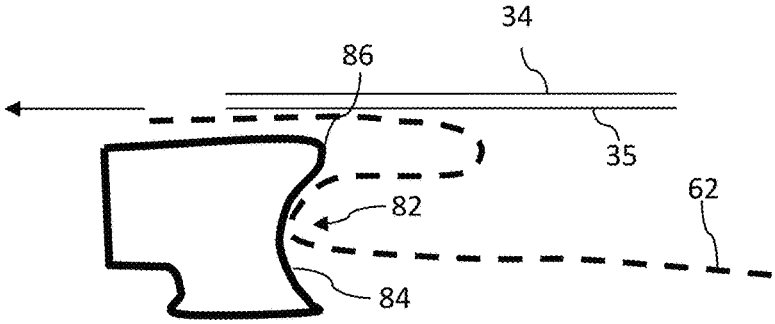
Figure 7C:
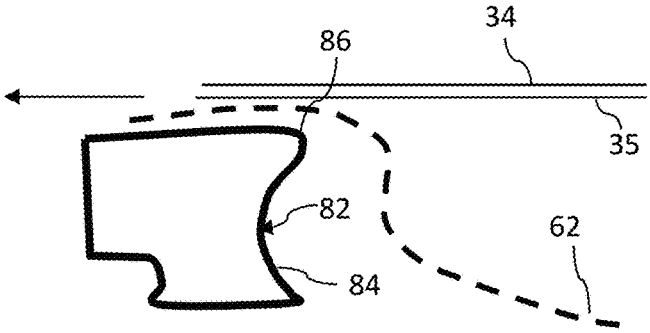

The concave face 82 may include a rounded top edge 86 that overhangs the concave face 82 towards the back wall 46 of the drawer 36, as particularly seen in FIGS. 7*a*-7*c*. The rounded top edge 86 is spaced below an underside 35 (FIG. 4) of the bottom 34 of the adjacent vertically stacked bin 22 to define a ticket path for tickets 62 above the component section 38 having a defined height 88 (FIG. 7*a*). This height 88 is designed so as not to restrict free passage of the tickets 62 as they are conveyed through the component section 38 while at the same time reducing the risk of folded ticket jams forming in the passage.

Referring to FIGS. 7*a*-7*c*, the radius of the rounded top edge 86 is selected so as to present a "gentle" curve that allows tickets that approach the edge at a negative angle to essentially unfold around the radius to prevent a ticket jam. In addition, the rounded top edge, 86, concave face 82, and height 88 of the ticket passage cooperate to prevent folded-ticket jams at the critical location where the tickets 62 unfold and travel through the component section 38. FIG. 7*a* depicts an incoming multi-layer fold of the tickets 62 as they travel in the direction of the arrow to the component section 38. FIG. 7*b* depicts the folded tickets 62 being pulled into the concave face 82 and rounded top edge 86, which causes the fold to be directed downwards. This action results in a "release" of the folds and a straightening out of the continuous interconnected tickets 62, as depicted in FIG. 7*c*.

The present invention also encompasses individual ones of the bins 22 discussed above for use in a multi-bin dispenser array 10 in a vertically stacked configuration with other bins 22.

The material particularly shown and described above is not meant to be limiting, but instead serves to show and teach various exemplary implementations of the present subject matter. As set forth in the attached claims, the scope of the present invention includes both combinations and sub-combinations of various features discussed herein, along with such variations and modifications as would occur to a person of skill in the art.

What is claimed is:

1. A lottery ticket dispenser array, comprising:

a plurality of interconnected stacked bins, wherein one or more of the bins further comprises:

a housing having a bottom and an open top;

a drawer slidable into and out of the housing, the drawer comprising an open top and at least one ticket compartment configured for receipt of a stack of interconnected lottery tickets in a laid-down orientation;

a component section adjacent a front of the drawer that automatically dispenses one or more of the interconnected lottery tickets through a dispense slot upon receipt of a dispense command;

a ramp disposed within the ticket compartment, the ramp angled upwards from a floor of the ticket compartment towards the component section; and a plurality of raised ridges extending across the ramp and spaced longitudinally apart along the ramp, wherein each ridge defines a retaining edge for progressively longer stacks of interconnected lottery tickets placed within the ticket compartment in the laid-down orientation.

2. The lottery ticket dispenser array as in claim 1, wherein for each bin, the drawer is configured to store and dispense at least two separate stacks of interconnected lottery tickets and comprises adjacent component sections and adjacent ticket compartments, with each ticket compartment comprising the ramp with plurality of raised teeth.

3. The lottery ticket dispenser array as in claim 1, wherein the ramp comprises a concave curved profile.

4. The lottery ticket dispenser array as in claim 1, wherein the ridges are angled towards a back wall of the drawer.

5. The lottery ticket dispenser array as in claim 1, wherein a first one of the ridges at a back edge of the ramp defines a first space between the first ridge and a back wall of the drawer for receipt of a first stack of interconnected lottery tickets.

6. The lottery ticket dispenser array as in claim 5, wherein a second one of the ridges is spaced from the first ridge further up the ramp such that a second space is defined between the second ridge and the back wall of the drawer for receipt of a second stack of interconnected lottery tickets that is longer than the first stack of interconnected lottery tickets.

7. The lottery ticket dispenser array as in claim 6, wherein a third one of the rides is spaced from the second ridge such that a third space is defined between the third ridge and the back wall the drawer for receipt of a third stack of interconnected lottery tickets that is longer than the second stack of interconnected lottery tickets.

8. The lottery ticket dispenser array as in claim 7, further comprising a vertically orientated concave face at a front edge of the ramp adjacent the component section that faces towards the back wall of the drawer, the concave face defining a retaining wall such that a fourth space is defined between the concave face and the back wall of the drawer for receipt of a forth stack of interconnected lottery tickets that is longer than the third stack of interconnected lottery tickets.

9. The lottery ticket dispenser array as in claim 1, further comprising a vertically orientated concave face at a front edge of the ramp adjacent the component section that faces towards a back wall of the drawer, the concave face defining a retaining wall such that a space is defined between the concave face and the back all of the drawer for receipt of a longest stack of interconnected lottery tickets receivable in the drawer.

10. The lottery ticket dispenser array as in claim 9, wherein the concave face comprises a rounded top edge that overhangs the concave face towards the back wall of the drawer, the rounded top edge spaced below a bottom of an adjacent vertically stacked bin to define a ticket path to the component section having a defined height.

11. A lottery ticket bin for use in a multi-bin dispenser array in a vertically stacked configuration with other bins, comprising:

a housing having a bottom and an open top;

a drawer slidable into and out of the housing, the drawer comprising an open top and at least one ticket compartment configured for receipt of a stack of interconnected lottery tickets in a laid-down orientation;

a component section adjacent a front of the drawer that automatically dispenses one or more of the interconnected lottery tickets through a dispense slot upon receipt of a dispense command;

a ramp disposed within the ticket compartment, the ramp angled upwards from a floor of the ticket compartment towards the component section; and a plurality of raised ridges extending across the ramp and spaced longitudinally apart along the ramp, wherein each ridge defines a retaining edge for progressively longer stacks of interconnected lottery tickets placed within the ticket compartment in the laid-down orientation.

12. The lottery ticket bin as in claim 11, wherein the ramp comprises a concave curved profile.

13. The lottery ticket bin as in claim 11, wherein the ridges are angled towards a back wall of the drawer.

14. The lottery ticket bin as in claim 11, wherein a first one of the ridges at a back edge of the ramp defines a first space between the first ridge and a back wall of the drawer for receipt of a first stack of interconnected lottery tickets.

15. The lottery ticket bin as in claim 14, wherein a second one of the ridges is spaced from the first ridge further up the ramp such that a second space is defined between the second ridge and the back wall of the drawer for receipt of a second stack of interconnected lottery tickets that is longer than the first stack of interconnected lottery tickets.

16. The lottery ticket bin as in claim 15, wherein a third one of the rides is spaced from the second ridge such that a third space is defined between the third ridge and the back wall the drawer for receipt of a third stack of interconnected lottery tickets that is longer than the second stack of interconnected lottery tickets.

17. The lottery ticket bin as in claim 16, further comprising a vertically orientated concave face at a front edge of the ramp adjacent the component section that faces towards the back wall of the drawer, the concave face defining a retaining wall such that a fourth space is defined between the concave face and the back wall of the drawer for receipt of a forth stack of interconnected lottery tickets that is longer than the third stack of interconnected lottery tickets.

18. The lottery ticket bin as in claim 11, further comprising a vertically orientated concave face at a front edge of the ramp adjacent the component section that faces towards a back wall of the drawer, the concave face defining a retaining wall such that a space is defined between the concave face and the back all of the drawer for receipt of a longest stack of interconnected lottery tickets receivable in the drawer.

19. The lottery ticket bin as in claim 18, wherein the concave face comprises a rounded top edge that overhangs the concave face towards the back wall of the drawer, the rounded top edge spaced below a bottom of an adjacent vertically stacked bin to define a ticket path to the component section having a defined height.

* * * * *